United States Patent [19]

Boehmler et al.

[11] 4,431,383

[45] Feb. 14, 1984

[54] MOTOR COMPRESSOR FOR REFRIGERATORS

[75] Inventors: Kurt Boehmler, Bamberg; Lothar Benzing, Giengen; Andreas Schneider, Nuremberg; Gerhard Rettinger, Bolheim, all of Fed. Rep. of Germany

[73] Assignee: Robert Bosch GmbH, Stuttgart, Fed. Rep. of Germany

[21] Appl. No.: 298,024

[22] Filed: Aug. 31, 1981

Related U.S. Application Data

[63] Continuation of Ser. No. 44,552, Jun. 1, 1979, abandoned.

[30] Foreign Application Priority Data

Jun. 8, 1978 [DE] Fed. Rep. of Germany ..... 2825129

[51] Int. Cl.[3] ..... F04B 39/00

[52] U.S. Cl. ..... 417/312; 417/363; 417/415; 417/902

[58] Field of Search ..... 417/312, 313, 363, 415, 417/902

[56] References Cited

U.S. PATENT DOCUMENTS

| | | | |
|---|---|---|---|
| 3,044,688 | 7/1962 | Frank et al. | 417/312 |
| 3,528,755 | 9/1970 | Valbjorn et al. | 417/312 |
| 3,610,784 | 10/1971 | Rundell | 417/415 |
| 3,614,384 | 10/1971 | Heitchue | 417/312 |
| 3,664,769 | 5/1972 | Knudsen et al. | 417/312 |
| 4,106,881 | 8/1978 | Stannow et al. | 417/363 |

*Primary Examiner*—Richard E. Gluck
*Attorney, Agent, or Firm*—Michael J. Striker

[57] ABSTRACT

A motor-driven compressor particularly for a refrigerator has a cylinder-and-piston unit whose piston is driven from a shaft of a rotor of an electric motor, two sound-damping chambers communicating with a cylinder of the cylinder-and-piston unit, and a bearing element mounted on a stator of the electric motor and having a portion forming a main bearing for the shaft of the rotor, a relatively small bridge-like portion overlapping only a part of a winding of the electric motor, and two legs located diametrically opposite one another and mounted on the stator of the electric motor. The sound-damping chambers may be of one piece with a cover of the cylinder and the latter may be a separate member without the cover.

15 Claims, 6 Drawing Figures

II
II
III
III
A
C
10
11
12
13
14
19
20
21
22
24
25
26
27
28
30
31
32
33
34
37
40
40
44
46

MOTOR COMPRESSOR FOR REFRIGERATORS

This is a continuation, of application Ser. No. 44,552, filed June 1, 1979, now abandoned.

BACKGROUND OF THE INVENTION

The present invention relates to a motor-driven compressor, particularly a compressor for a refrigerator.

A compressor of this general type has a bearing element which forms a cylinder as well as sound-damping chambers and has a large outer surface. The thus-constructed bearing element is a relatively massive part which overlaps a large part of a winding of an electric motor. This is disadvantageous in that the cooling of the motor winding is not sufficient. Thereby heating of the cylinder especially by hot pressurized gases in a pressure sound-damping chamber is high so that the output and the service life of the compressor are reduced.

SUMMARY OF THE INVENTION

Accordingly, it is an object of the present invention to provide a motor-driven compressor which avoids the disadvantages of the prior art.

More particularly, it is an object of the present invention to provide a compressor in which an upper part of a winding of an electric motor is not considerably overlapped and therefore is well ventilated and cooled.

Another object of the present invention is to provide a compressor in which a bearing element has a relatively small mass whereby the compressor has a smaller weight than the known compressors.

In keeping with these objects and with others which will become apparent hereinafter one feature of the present invention resides, briefly stated, in a motor-driven compressor in which a bearing element forming a main bearing for a shaft of an electric motor has a relatively narrow bridge-like portion which is arranged so as to cover only a part of the width of an upper portion of a winding of the electric motor, and two oppositely located supporting legs mounted on a stator of the electric motor.

In such a construction the upper portion of the winding is covered only over a small part by the bearing element and thereby is very well ventilated and cooled. The mass of the bearing element is relatively small and the compressor therefore has a low weight.

Another feature of the present invention is that a cylinder-and-piston unit is separated from means forming sound-damping chambers since the latter is casted on a cover and the cylinder without the cover is a separate member. This eliminates heating of the cylinder by hot pressurized gases and the cylinder can be cooled especially well. Thereby the output and the service life of the compressor are increased.

Still another feature of the present invention is that the bearing element together with an electric motor which drives the compressor, are supported by spring means on a lower part of a casing of the machine. The spring means may be formed as springs each having a first end portion received in a hole provided in a stator of the electric motor, and a second end portion supported on a pin provided on a bottom of the casing.

A further feature of the present invention is that two parallel consoles are arranged on an upper surface of the bearing element in the region of one of its legs, and the cylinder of the cylinder-and-piston unit is located between the consoles.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
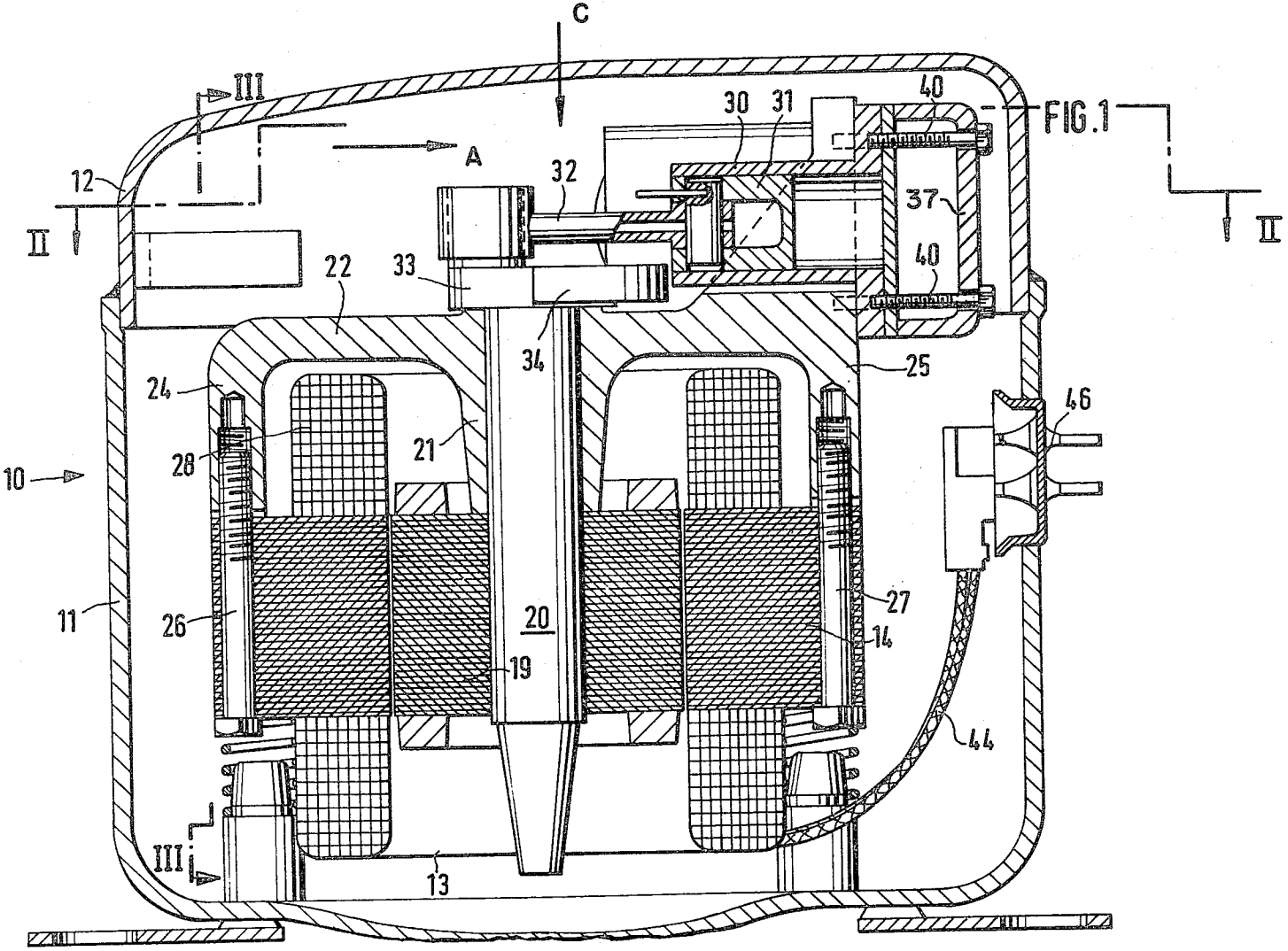
FIG. 1 is a view showing a longitudinal section of a motor-driven compressor.
Figure 2:
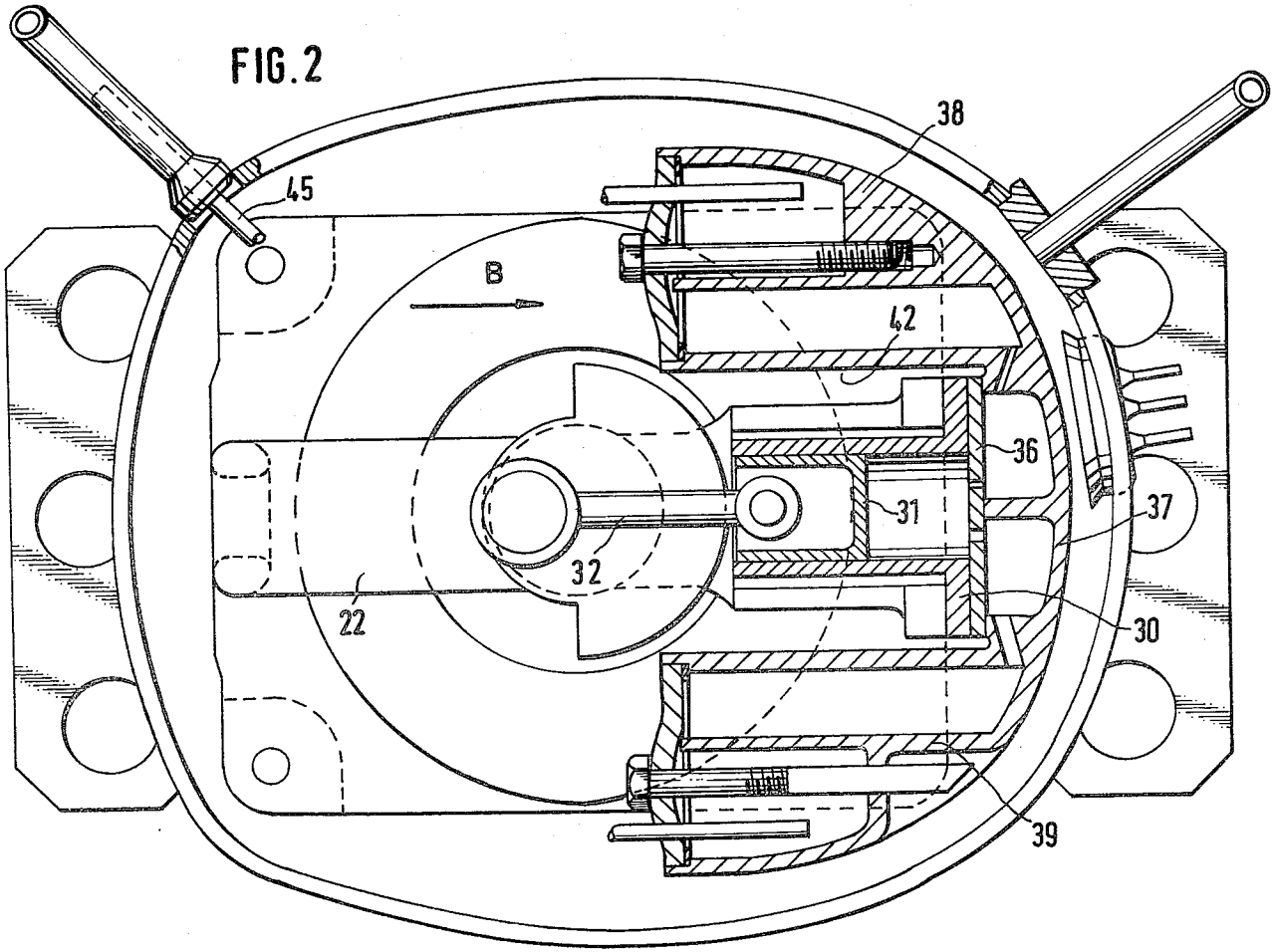
FIG. 2 is a plan view of the compressor shown in FIG. 1 in a section taken along the line II—II in FIG. 1.

A motor-driven compressor in accordance with the present invention is accommodated in a casing 10 which has a lower part 11 and an upper part 12. The parts of the casing 10 are welded to one another.

An electric motor 13 is arranged in the casing 10. A stator 14 of the electric motor 13 are supported by springs 15 on a base plate 16 arranged in the lower part 11 of the casing 10. The springs 15 are supported at their one ends on conical pins 17 arranged in blind holes 16' which are provided in the stator 14. The other ends of the springs 15 are supported on conical pins 18 which are mounted on a base plate 16. The pins 17 and 18 are identical.

A rotor 19 of the electric motor 13 is mounted on a shaft 20 which is guided and supported in a main bearing 21. The main bearing 21 is a part of a bearing element having a portion 22 which is relatively small and bridge-shaped. The bearing element has two legs 24 and 25 which are located diametrically opposite one another. The bridge-shaped portion 22, the main bearing 21, and the legs 24 and 25 of the bearing element are of one piece with one another and are supported on the stator 14. The bearing element is connected by its legs 24 and 25 with the stator 14 with the aid of screws 26 and 27.

Figure 3:
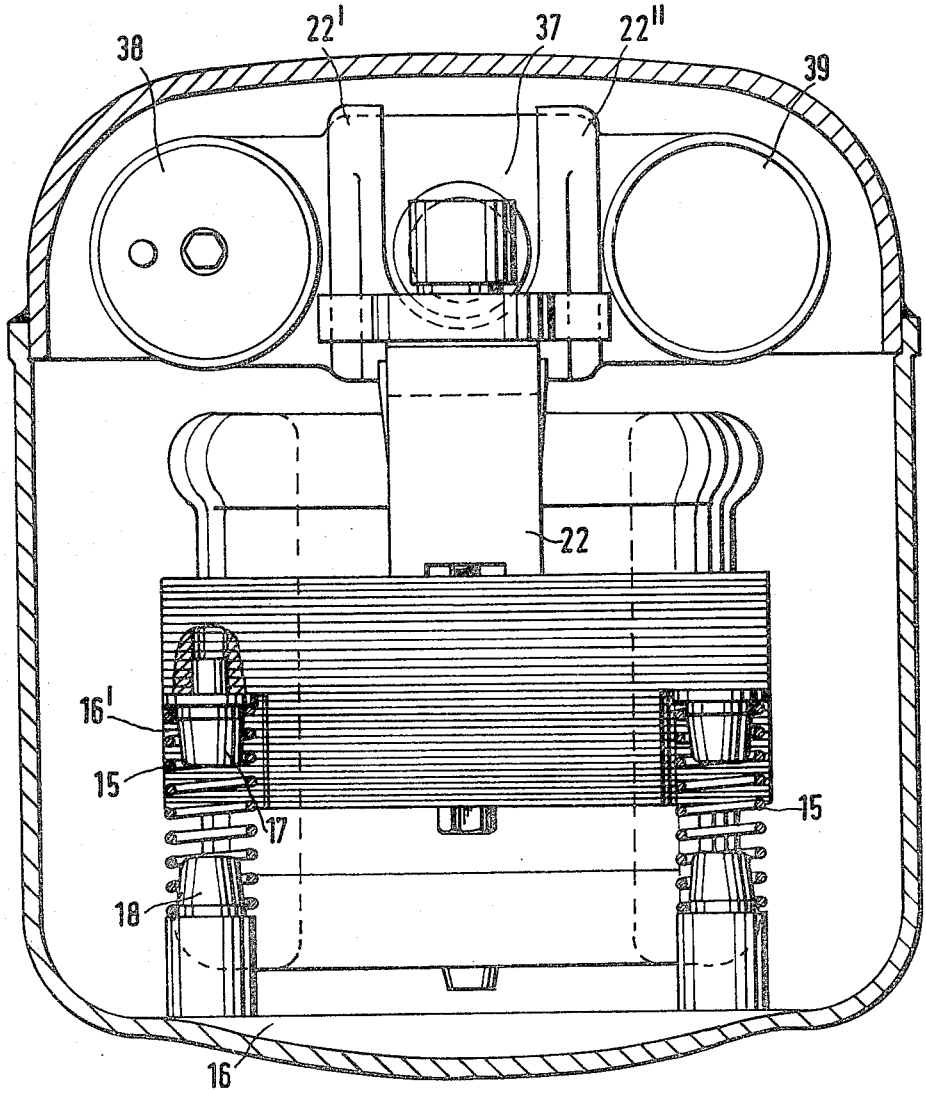
FIG. 3 is a view showing a section taken along line III—III in FIG. 1.
Figure 4:
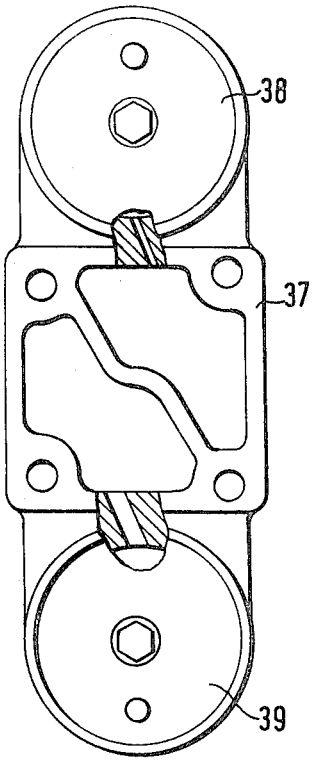
FIG. 4 is a view showing a part forming sound-damping chambers as seen in direction of the arrow A in FIG. 1 or the arrow B in FIG. 2 of the compressor.
Figure 5:
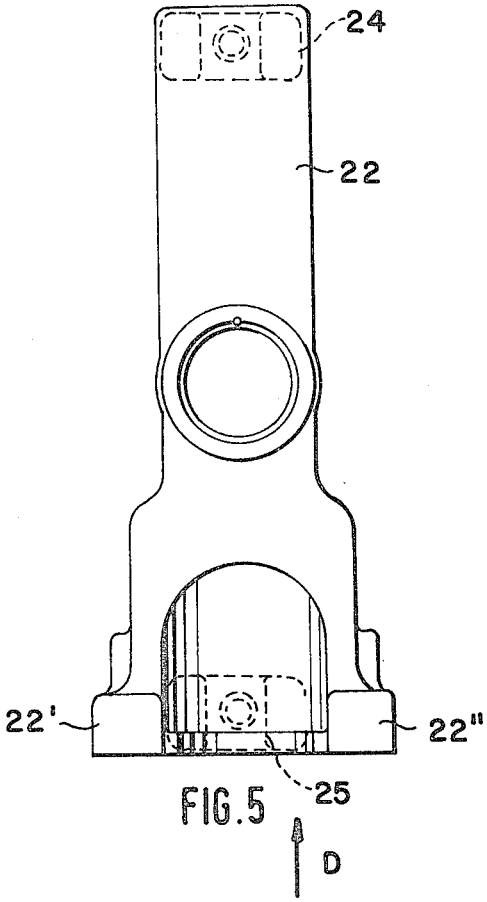
FIG. 5 is a view showing a bearing element of the compressor from above, as seen in direction of the arrow C in FIG. 1.
Figure 6:
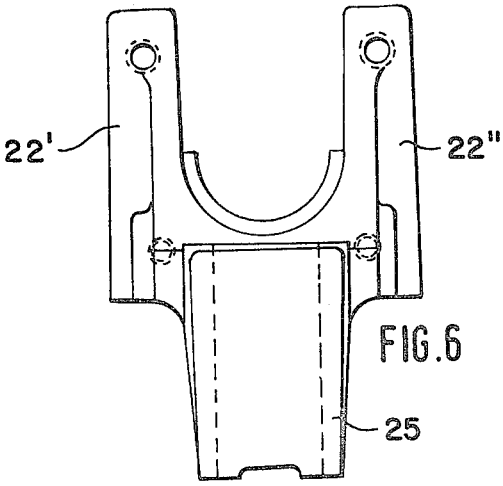
FIG. 6 is a view showing the bearing element of the compressor, as seen in direction of the arrow D in FIG. 5.

The bridge-shaped portion 22 of the bearing element overlaps an upper part of a winding 28 of the electric motor 13, but covers only a small region of the width of the upper part of the winding corresponding to the small width of the bridge-shaped portion 22 of the bearing element, as can be seen from FIG. 3. Thereby the winding 28 is sufficiently cooled.

An upper part of the bearing element above the leg 25 is provided with two parallel consoles 22' and 22'' which are connected with the bridge-shaped portion 22 and form a U-shaped opening therebetween. A cylinder 30 of a cylinder-and-piston unit of the compressor is located above the leg 25. A piston 31 is accommodated in the cylinder 30 and is driven in reciprocating movement through a piston rod 32 and an eccentric 33 connected with the shaft 20.

The cylinder 30 of the cylinder-and-piston unit is closed by a cover 37 with interposition of a valve plate 36. A suction-side sound-damping chamber 38 and a pressure-side sound-damping chamber 39 are formed in the cover 37. Advantageously, these together form an integral member which is manufactured as an aluminum die-cast part. This integral member together with the cylinder 30 is mounted on the bearing element and its consoles by screws 40.

Tightening of the screws 26 and 27 for mounting the bearing element is performed after adjustment of an air gap between the stator 14 and the rotor 19, and thus after insertion of the shaft 20 and pressing-on of the rotor 19. After this, the cylinder 30 together with the piston inserted therein and with the piston rod and the piston pin are inserted from above into the U-shaped opening onto the bearing element so that an ear of the piston rod is fitted onto the eccentric 33. Finally, the cylinder 30 together with the cylinder cover 37 are mounted on the bearing element by the screws 40.

The thus-assembled inner parts of the compressor are placed into the lower part 11 of the casing 10 onto the pressure springs 15 which are seated on the conical pins. After this it is only required to connect an electric connecting cable 44 to a plug 46 of the electric motor 13 and to solder a pressure pipe 45.

It will be understood that each of the elements described above, or two or more together, may also find a useful application in other types of constructions differing from the types described above.

While the invention has been illustrated and described as embodied in a motor-driven compressor for a refrigerator it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A motor-drive compressor having an electric motor having a rotor, a stator, a winding and a shaft rotatable about an axis, the compressor comprising a cylinder-and-piston unit having a cylinder, and a piston arranged to be driven from the rotatable shaft of the electric motor and movable in said cylinder; means forming sound-damping chambers which communicate with said cylinder of said cylinder-and-piston unit; a bearing element arranged to be mounted on the stator of the electric motor and to support the rotatable shaft of the electric motor, said cylinder-and-piston unit and said sound-damping chambers, said bearing element having a bridge-like portion with a dimension, in a first direction transverse to said axis, which is smaller than that of the winding of the electric motor so as to cover only a part of the winding in said first transverse direction, said bearing element having a central portion connected with said bridge-like portion in the region of the axis and forming a bearing for the shaft of the electric motor, said bearing element also having two leg portions connected with said bridge-like portion and extending in a direction parallel to said axis, said leg portions being spaced from one another in a second direction which is transverse to said first transverse direction and to said axis and located at opposite sides of said central portion in spaced relationship therewith, said leg portions being arranged to be supported on and connected with the stator of the electric motor; and means for connecting said leg portions of said bearing element with the stator of the electric motor.

2. A compressor as defined in claim 1, wherein the shaft of the electric motor is a crankshaft, said central portion of said bearing element being arranged to receive a part of the crankshaft.

3. A compressor as defined in claim 1, wherein the axis of the shaft and thereby the electric motor is upright and the winding of the electric motor has an upper portion, said bridge-like portion of said bearing element overlapping the upper portion of the winding in said second transverse direction from above.

4. A compressor as defined in claim 1; and further comprising a removable cover connected with said cylinder of said cylinder-and-piston unit, said cylinder without said cover forming a removable unit and being mounted on said bearing element.

5. A compressor as defined in claim 4, wherein said chamber forming means includes first means forming one chamber and second means forming another chamber, said first means and said second means being located at opposite sides of said cylinder and forming together with said cover an integral member.

6. A compressor as defined in claim 5, wherein said integral member together with said cylinder are mounted on said bearing element; and further comprising mounting means for mounting the same on said bearing element and including screws.

7. A compressor as defined in claim 3; and further comprising a casing accommodating the electric motor, said cylinder-and-piston unit, said means, and said bearing element, said casing having a lower part and an upper part; and further comprising spring means operative for spring-supporting said bearing element together with the electric motor, on said lower part of said casing.

8. A compressor as defined in claim 7, wherein said spring means includes a plurality of springs.

9. A compressor as defined in claim 8, wherein the stator has a plurality of holes and said casing has a bottom wall, each of said springs having a first end portion arranged to be received in a respective one of the holes of the stator and a second end portion supported on said bottom of said casing.

10. A compressor as defined in claim 9, wherein said bottom of said casing is provided with a plurality of conical pins, the second end portion of each of said springs being supported on a respective one of said conical pins.

11. A compressor as defined in claim 3, wherein said bearing element has an upper U-shaped portion connected with said bridge-like portion and two consoles spaced from one another in said first direction, said cylinder of said cylinder-and-piston unit being located between said consoles.

12. A compressor as defined in claim 11, wherein said consoles extend parallel to one another.

13. A compressor as defined in claim 11, wherein said consoles are arranged in the region of one of said leg portions of said bearing element.

14. A compressor as defined in claim 1, wherein said bridge-like portion, said central portion and said leg portions of said bearing member are of one-piece with one another.

15. A compressor as defined in claim 1, wherein said bearing element is coaxial with the shaft of the electric motor, said leg portions being located diametrically opposite and symmetrical to one another.

* * * * *